US008207682B2

(12) United States Patent
Lan et al.

(10) Patent No.: US 8,207,682 B2
(45) Date of Patent: Jun. 26, 2012

(54) LIGHT SOURCE CONTROL DEVICE AND METHOD

(75) Inventors: Yu-Chin Lan, Hsin-Chu (TW); Wei-Jen Chou, Hsin-Chu (TW); Shih-Yuan Yu, Hsin-Chu (TW); Chien-Chung Hsiao, Hsin-Chu (TW)

(73) Assignee: Young Lighting Technology Inc., Hsin-Chu (TW)

( * ) Notice: Subject to any disclaimer, the term of this patent is extended or adjusted under 35 U.S.C. 154(b) by 413 days.

(21) Appl. No.: 12/544,030

(22) Filed: Aug. 19, 2009

(65) Prior Publication Data

US 2010/0127638 A1 May 27, 2010

(30) Foreign Application Priority Data

Nov. 24, 2008 (TW) ..... 97145354 A

(51) Int. Cl.
*H05B 37/02* (2006.01)

(52) U.S. Cl. ..... 315/293; 315/313

(58) Field of Classification Search ..... 315/291, 315/292, 294, 307, 312, 313
See application file for complete search history.

(56) References Cited

U.S. PATENT DOCUMENTS

| | | | | |
|---|---|---|---|---|
| 4,550,221 | A | 10/1985 | Mabusth | |
| 7,064,498 | B2 * | 6/2006 | Dowling et al. | 315/291 |
| 7,550,935 | B2 * | 6/2009 | Lys et al. | 315/318 |
| 7,733,033 | B2 * | 6/2010 | Baaijens et al. | 315/292 |

* cited by examiner

*Primary Examiner* — Don Le
(74) *Attorney, Agent, or Firm* — Kirton McConkie; Evan R. Witt

(57) ABSTRACT

A light source control method and a light source control device are used for controlling a light source. The light source control device includes a position detecting sensor and a microcontroller. The light source control method includes steps of generating a first signal according to an object touching a position of the position detecting sensor, and generating a control signal according to a light source adjustable parameter set corresponding to the first signal for controlling an illuminating status of the light source. The light source adjustable parameter set includes a plurality of color value components. The control signal is generated by the microcontroller according to the color value components.

12 Claims, 7 Drawing Sheets

LIGHT SOURCE CONTROL DEVICE AND METHOD

BACKGROUND OF THE INVENTION

1. Field of the Invention

The invention relates to a light source control device and a light source control method, and more particularly to a light source control device and a light source control method by using a position detecting sensor and a microcontroller to control the illuminating status of the light source.

2. Description of the Related Art

The common switches for controlling light sources are usually classified into two types, i.e. push switches and knob switches.

FIG. 1A is a schematic view illustrating a typical push switch. The use of the push switch 10 may generate two control signals. As known, it is not feasible to use the push switch to execute complicated controlling operations (e.g. the color or brightness controlling operation) on account of many reasons. For example, since there are no evident sign on the push switch to indicate the brightness and the color of the beam, the user is confused with the push switch. In addition, the colors of the beam emitted by the light source are predetermined. That is, the light color selectivity is not diversified. For increasing the selectivity of the light colors or brightness values, the frequency of operating the push switch is increased. Since the push switch is a mechanical switch, the use of the push switch may incur some mechanical problems such as mechanical fatigue or poor contact. Moreover, the push switch fails to be remotely controlled.

FIG. 1B is a schematic view illustrating a typical knob switch. By rotating the knobs 151 and 152 of the knob switch 15, the user may adjust the color and the brightness value of the beam emitted by the light source. Since the knob switch 15 is also a mechanical switch, the use of the knob switch 15 may also incur some mechanical problems such as mechanical fatigue or poor contact. Moreover, the knob switch 15 fails to be remotely controlled.

SUMMARY OF THE INVENTION

The invention provides a light source control device and a light source control method by using a position detecting sensor and a microcontroller to control the illuminating status of the light source.

To achieve at least of the above-mentioned advantages, one embodiment of the invention provides a light source control device for controlling a light source. The light source control device includes a position detecting sensor and a microcontroller. The position detecting sensor is capable of generating a first signal according to an object touching a position of the position detecting sensor. The microcontroller is communicated with the position detecting sensor and capable of generating a control signal according to a light source adjustable parameter set corresponding to the first signal for controlling an illuminating status of the light source. The light source adjustable parameter set includes a plurality of color value components. The microcontroller is capable of generating the control signal according to the color value components.

To achieve at least of the above-mentioned advantages, another embodiment of the invention provides a light source control method. The light source control method includes steps of generating a first signal according to an object touching a position of the position detecting sensor, and generating a control signal according to a light source adjustable parameter set corresponding to the first signal for controlling an illuminating status of the light source. The light source adjustable parameter set includes a plurality of color value components. The microcontroller is capable of generating the control signal according to the color value components.

In accordance with the light source control device and the light source control method of the embodiments of the invention, when the user's finger touches a position of the position detecting sensor, the beam emitted by the light source is adjusted to have the color, the color temperature or the brightness value corresponding to the touched position under control of the microcontroller. By using the light source control device and the light source control method of the embodiments of the invention, color selectivity becomes more diverse so as overcome the drawbacks encountered from the prior art.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The embodiments of the invention may be better understood through the following description with reference to the accompanying drawings, in which.

DETAILED DESCRIPTION OF THE EMBODIMENT

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be located in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "connected," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component directly or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1A:
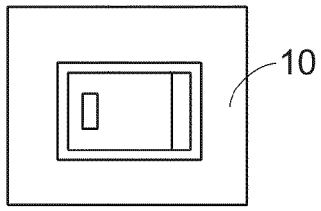
FIG.1A PRIOR ART
FIG. 1A is a schematic view illustrating a typical push switch.
Figure 1B:
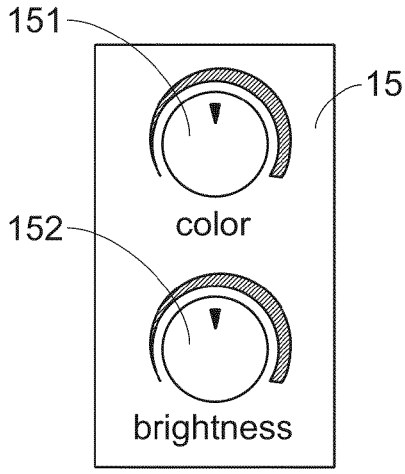
FIG.1B PRIOR ART
FIG. 1B is a schematic view illustrating a typical knob switch.
Figure 2:
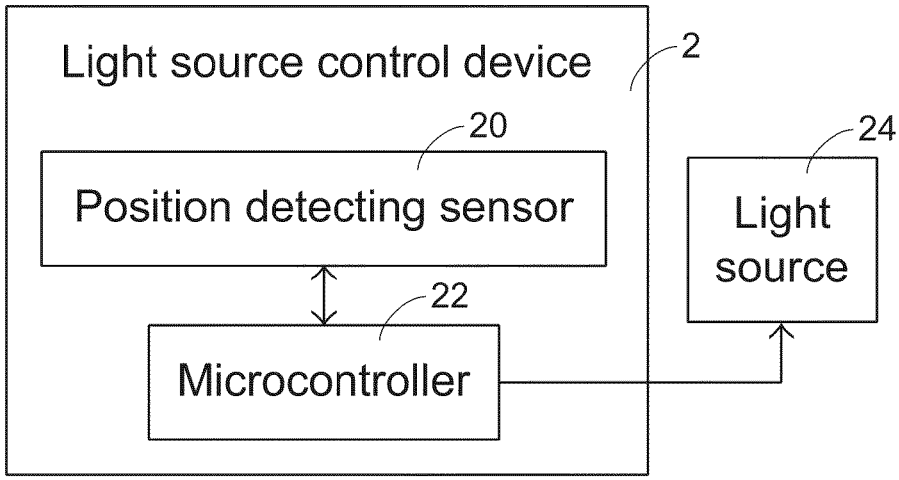
FIG. 2 is a schematic functional block diagram illustrating a light source control device according to an embodiment of the invention.

Referring to FIG. 2, the light source control device 2 of FIG. 2 is used for controlling a light source 24. The light source control device 2 includes a position detecting sensor 20 and a microcontroller 22. The microcontroller 22 is communicated with the position detecting sensor 20 and the light source 24. An example of the position detecting sensor 20 includes a touchpad (or track pad) or a touch panel (or touch screen).

In accordance with the embodiment of the invention, the position detecting sensor 20 and the microcontroller 22 are used to control the color, the color temperature and the brightness value of the beam emitted by the light source 24.

Figure 3A:
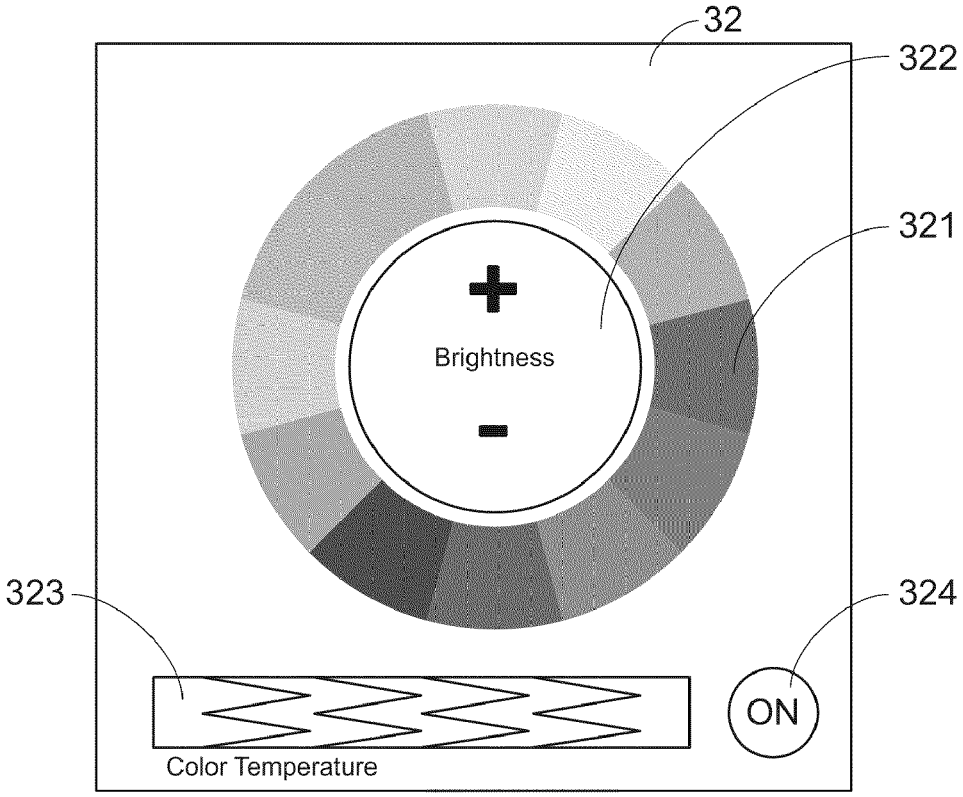
FIG. 3A is a schematic view of a first touchpad used in the light source control device of the invention.

Referring to FIG. 3A, the position detecting sensor 20 is for example a touchpad 32. As shown in FIG. 3A, a plurality of patterns for assisting in adjusting an illuminating status of the light source 24 are provided or printed on the surface of the touchpad 32. As shown in FIG. 3A, the patterns include for example a color pattern 321, a brightness pattern 322, a color temperature pattern 323, and a switch pattern 324. That is, the user may adjust the color temperature and the brightness value of the beam emitted by the light source via these patterns. For example, when the user's finger touches a position of the color pattern 321, the beam emitted by the light source 24 is adjusted to have the color corresponding to the touched position of the color pattern 321 under control of the microcontroller 22. Similarly, when the user's finger is moved on the brightness pattern 322 in a horizontal or vertical direction, the beam emitted by the light source 24 is adjusted to have the brightness value corresponding to the touched position of the brightness pattern 322 under control of the microcontroller 22. Similarly, when the user's finger is moved on the color temperature pattern 323 in a horizontal or vertical direction, the beam emitted by the light source 24 is adjusted to have the color temperature corresponding to the touched position of the color temperature pattern 323 under control of the microcontroller 22. In other words, when the user's finger touches a position of the color pattern 321 on the touchpad 32 intuitively, the microcontroller 22 controls the light source 24 to emit the beam having the color corresponding to the touched position of the color pattern 321.

According to the working principle of the touchpad 32, when the user's finger touches a position of any pattern, the touchpad 32 generates a coordinate signal. The coordinate value contained in the coordinate signal is correlated with a light source adjustable parameter set recorded in the microcontroller 32. The light source adjustable parameter set includes for example a set of color values. According to the light source adjustable parameter set, the microcontroller 22 generates a control signal. In response to the control signal, a selected color of the beam emitted by the light source 24 is produced.

The common color values are RGB values. Individual R (Red), G (Green) and B (Blue) levels indicate individual colors of the pixels. For example, the RGB values R255, G255 and B255 indicate white color; and the RGB values R0, G0 and B0 indicate black color. The light source adjustable parameter set includes a plurality of color value component parameters. The color value component parameters include for example RGB values, color parameters, brightness parameters, and color temperature parameters. According to these parameters, the microcontroller 22 generates corresponding control signals to control the color, the color temperature, and the brightness value of the beam emitted by the light source 24.

The patterns of the touchpad 32 may be modified in order to the meet the user-made demand. The light source adjustable parameter set corresponding to the coordinate signals is predetermined and stored in the microcontroller 22. In this embodiment, the color pattern 321 is a multi-color ring showing the adjustable colors of the beam emitted by the light source 24. For example, if the user touches a red site of the multi-color ring, the touchpad 32 covered by the red site generates a corresponding coordinate signal. According to the coordinate signal, the microcontroller 22 generates a control signal corresponding to the predetermined light source adjustable parameter set. In response to the control signal, the color values of the beam emitted by the light source 24 are adjusted to be for example R255, G0, and B0. As a consequence, the light source 24 emits a red light beam.

When the user's finger is horizontally moved on the color temperature pattern 323 of the touchpad 32, the capacitive sensors touched by the user's finger successively generate coordinate signals. According to the coordinate signals, the microcontroller 22 generates control signals corresponding to the light source adjustable parameter set so as to control the color temperature of the beam emitted by the light source 24.

Similarly, when the symbols "+" or "−" shown on the brightness pattern 322 is touched by the user's finger, the brightness value of the beam emitted by the light source 24 is increased or decreased.

Similarly, when the switch pattern 324 is pressed down or touched by the user's finger, the light source 24 is turned on or turned off.

Figure 3B:
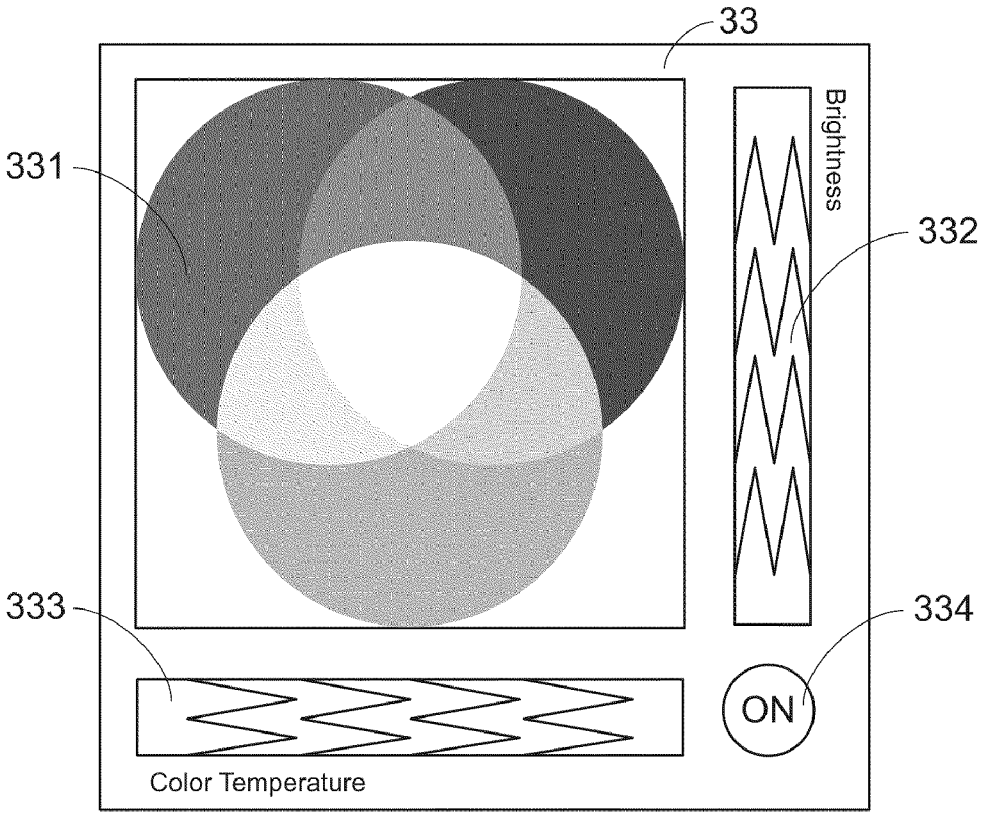
FIG. 3B is a schematic view of a second touchpad used in the light source control device of the invention.
Figure 3C:
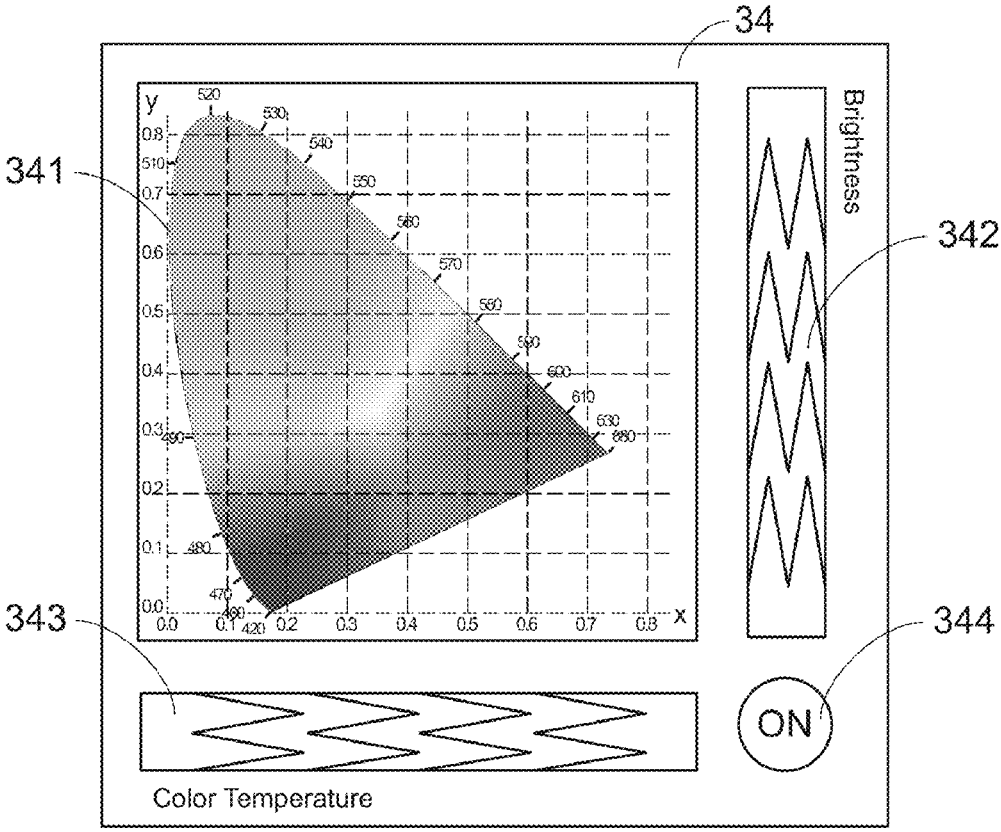
FIG. 3C is a schematic view of a third touchpad used in the light source control device of the invention.

Referring to FIGS. 3B and 3C, the color pattern 331 includes three primary color sites and the superimposed sites of these three primary color sites. The color pattern 341 includes a set of gradient colors. When the user's finger touches a position of the color pattern 331 or 341, the beam emitted by the light source 24 is adjusted to have the color corresponding to the touched position of the color pattern 331 or 341 under control of the microcontroller 22. Similarly, when the user's finger is horizontally moved on the color temperature pattern 333 or 343, the beam emitted by the light source 24 is adjusted to have the color temperature corresponding to the touched position of the color temperature pattern 333 or 343 under control of the microcontroller 22. Similarly, when the user's finger is vertically moved on the brightness pattern 332 or 342, the beam emitted by the light source 24 is adjusted to have the brightness value corresponding to the touched position of the brightness pattern 332 or 342 under control of the microcontroller 22.

In some embodiments, the above-mentioned touchpad may be replaced by a touch panel. Similarly, a plurality of patterns are shown on the touch panel. When the user's finger touches a position of the touch panel, the touch panel generates a coordinate signal. According to the light source adjustable parameter set correlated with the coordinate signal, the microcontroller 22 generates a control signal. In response to the control signal, the illuminating status of the light source 24 is adjusted. Likewise, the patterns of the touch panel may be changed in order to meet the user-made demand. As the color number of the beam emitted by the light source is increased, the color number included in the color pattern is increased.

Figure 4A:
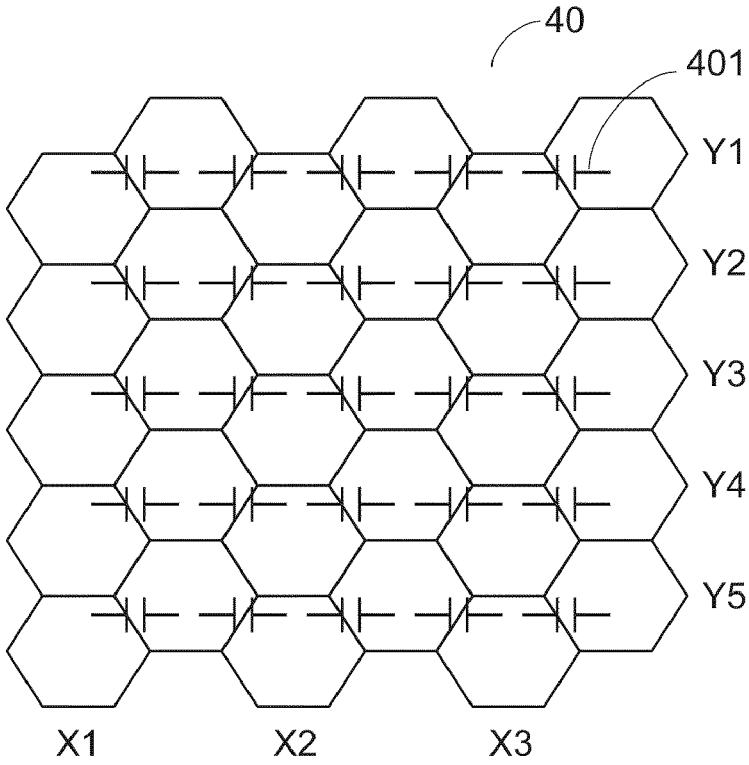
FIG. 4A is a schematic view of a capacitive touchpad used in the light source control device of the invention.

According to the sensing principles, touchpads and touch panels are classified into four types, i.e. resistive, capacitive, surface acoustic wave, and optics types. Hereinafter, a capacitive touchpad is illustrated with reference to FIGS. 4A and 4B. As shown in FIG. 4A, the capacitive touchpad includes a plurality of capacitive sensors 401. The capacitive sensors 401 are capacitors and disposed on a printed circuit board (PCB) 40 in an array arrangement. The X1, X2, X3, Y1, Y2, Y3, Y4 and Y5 axes of the capacitive touchpad are communicated with the microcontroller 22. The capacitance values of the capacitive sensors 401 in the array arrangement are periodically detected by the microcontroller 22. The capacitive sensor 401 is defined by two adjacent copper foils on the printed circuit board 40. In other words, two adjacent copper foils and the space distant from the adjacent copper foils collectively define one capacitive sensor 401.

Figure 4B:
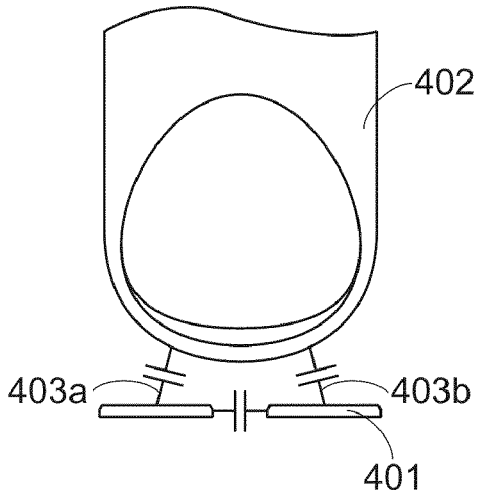
FIG. 4B is a schematic view illustrating the capacitance change of the capacitive sensor when a conductor approaches the capacitive sensor.

When the distance between a conductor and the capacitive sensors 401 is changed, the capacitance value of the capacitive sensor 401 is varied. As shown in FIG. 4B, when a conductor (e.g. a user's finger) 402 touches the capacitive sensor 401, two capacitors 403*a* and 403*b* connected with the capacitive sensor 401 are generated. That is, when the user's finger 402 touches the capacitive sensor 401, the capacitance value of the capacitive sensor 401 is increased. When the user's finger 402 is away from the capacitive sensor 401, the capacitance value of the capacitive sensor 401 is decreased. The capacitance values of the capacitive sensors 401 in the array arrangement are periodically detected by the microcontroller 22. According to the capacitance change, the microcontroller 22 may determine whether any user's finger 402 touches a position of the capacitive sensor 401.

When the user's finger is moved on the color pattern above the capacitive sensors, the capacitive sensors touched by the user's finger successively generate coordinate signals. According to the coordinate signals, the microcontroller 22 generates control signals in accordance with the light source adjustable parameter set so as to control the illuminating status of the light source 24. In other words, when the user's finger is moved on the touchpad 32, the illuminating status of the light source 24 is changed.

The light source 24 includes a plurality of light emitting diodes (LEDs). For example, the light source 24 is a multi-color RGB LED device containing red, green and blue LEDs. By changing the intensities of the red, green and blue LEDs, the R, G, B color levels are adjustable. After the red, green and blue beams emitted by the red, green and blue LEDs of the multi-color RGB LED device are mixed, a resultant light beam with a desired color is produced. In other words, the intensities of the red, green and blue LEDs may influence the color of the resultant light beam. Moreover, the intensities of the red, green and blue LEDs may be adjusted by a pulse width modulation (PWM) technology or an analog brightness-adjusting technology.

Since LED is a current-driven component, the illuminating intensity of LED is substantially in direct proportion to the magnitude of the current. That is, as the magnitude of the current is increased, the illuminating intensity of LED is increased. According to the analog brightness-adjusting technology, the illuminating intensity of LED is adjusted by changing the LED driving current. For example, if the current passing through the LED is increased by 50%, the illuminating intensity of LED is increased correspondingly. Whereas, if the current passing through the LED is decreased by 50%, the illuminating intensity of LED is decreased correspondingly. According to the pulse width modulation (PWM) technology, the ratio of the on duration to the off duration of the LED is adjusted. In other words, the illuminating intensity is adjusted by controlling the duty cycle of the LED according to the PWM technology. Since the LED is alternately conducted or shut off at a high speed that fails to be visually detected with the naked eyes, an illusion of color change is created. As the duty cycle of the LED is increased, the brightness value sensed by the observer is increased.

The microcontroller 22 has a general purpose input/output (GPIO) pin or an output pin. Via the GPIO pin or the output pin, the control signal generated by the microcontroller 22 is transmitted to the light source 24 so as to control the color values of the light source 24. The control signal is for example a PWM signal or an analog brightness-adjusting signal. In response to the PWM signal, the duty cycle of the LED current is changed. In response to the analog brightness-adjusting signal, the current passing through the LED is changed and thus the illuminating intensity of LED is adjusted. For example, for adjusting the color values of the light source 24 to be RGB values R0, G0 and B0 (e.g. black colors), the microcontroller 22 generates the PWM signal to the red, green and blue LEDs of the RGB LED device through the GPIO pin or the output pin. As a consequence, the red, green and blue beams emitted by the red, green and blue LEDs of the light source 24 and having the intensities corresponding to the RGB values R0, G0 and B0 are mixed to produce a desired color.

Figure 5:
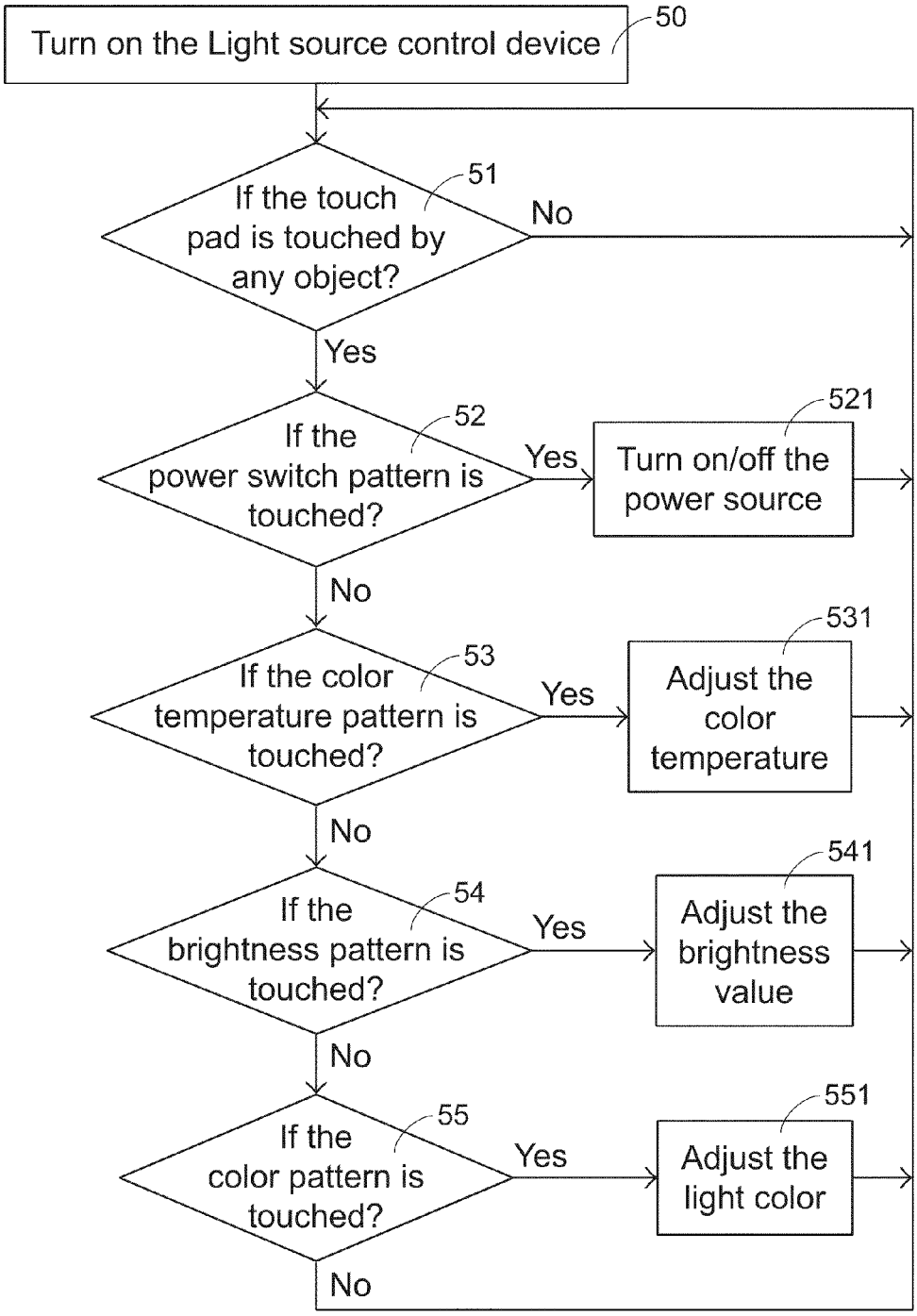
FIG. 5 is a flowchart illustrating a light source control method according to an embodiment of the invention.

Referring to FIG. 5, a light source device control method is provided. First of all, the light source control device 2 is powered on (Step 50). Meanwhile, the color values of the beam emitted by the light source 24 are predetermined in the light source control device 2 or stored at the previous running time. Next, the microcontroller 22 periodically detects and determines whether an object (e.g. a user's finger) touches the touchpad (Step 51). If the touchpad is not touched by the user's finger, the process is returned to the Step 51 and the Step 51 is executed unceasingly. That is, the microcontroller 22 may realize the position touched by the user's finger according to the coordinate signals generated by the capacitive sensors. According to the position touched by the user's finger, the microcontroller 22 generates a corresponding control signal to control the power status or the color values of the beam emitted by the light source 24. If the microcontroller 22 detects and determines that the touchpad is touched by the user's finger, the microcontroller 22 detects and determines whether the power switch pattern is touched by the user's finger (Step 52). If the microcontroller 22 detects and determines that the power switch pattern is touched by the user's finger, the microcontroller 22 generates a first control signal. In response to the first control signal, the power source 24 is turned on or turned off (Step 521) and then the process is returned to the Step 51. Whereas, if the power switch pattern is not touched by the user's finger, the microcontroller 22 detects and determines whether the color temperature pattern is touched by the user's finger (Step 53). If the microcontroller 22 detects and determines that the color temperature pattern is touched by the user's finger, the microcontroller 22 generates a second control signal according to the light source adjustable parameter set corresponding to the coordinate signal generated by the touched capacitive sensor. In response to the second control signal, the color temperature of the beam emitted by the light source 24 is adjusted (Step 531) and then the process is returned to the Step 51. Whereas, if the color temperature pattern is not touched by the user's finger, the microcontroller 22 detects and determines whether the brightness pattern is touched by the user's finger (Step 54). If the microcontroller 22 detects and determines that the brightness pattern is touched by the user's finger, the microcontroller 22 generates a third control signal according to the light source adjustable parameter set corresponding to the coordinate signal generated by the touched capacitive sensor. In response to the third control signal, the brightness value of the beam emitted by the light source 24 is adjusted (Step 541) and then the process is returned to the Step 51. Whereas, if the brightness pattern is not touched by the user's finger, the microcontroller 22 detects and determines whether the color pattern is touched by the user's finger (Step 55). If the microcontroller 22 detects and determines that the color pattern is touched by the user's finger, the microcontroller 22 generates a fourth control signal according to the light source adjustable parameter set corresponding to the coordinate signal generated by the touched capacitive sensor. In response to the fourth control signal, the color of the beam emitted by the light source 24 is adjusted (Step 551) and then the process is returned to the Step 51. Whereas, if the color pattern is not touched by the user's finger, the process is also returned to the Step 51.

By using the wireless communication technology, the light source control device 2 may control a single light source or a plurality of light sources. For example, a wireless signal receiver and a wireless signal emitter are respectively disposed at the light source side and the microcontroller 22. The control signal generated by the microcontroller 22 is encoded by the wireless signal emitter and then transmitted to the wireless signal receiver at the light source side. The encoded control signal is decoded by the wireless signal receiver, so that the color values of the beam emitted by the light source are controlled in response to the control signal. Accordingly, the color values of the beam emitted by the light source may be adjusted by the light source control device 2 at any location. Moreover, the light sources may be controlled by the light source control device 2. An example of the wireless signal emitter includes but is not limited to an infrared signal emitter, a Bluetooth signal emitter, a short wave signal emitter, an ultrasonic signal emitter or a radio frequency signal emitter. An example of the wireless signal receiver includes but is not limited to an infrared signal receiver, a Bluetooth signal receiver, a short wave signal receiver, an ultrasonic signal receiver or a radio frequency signal receiver.

Figure 6:
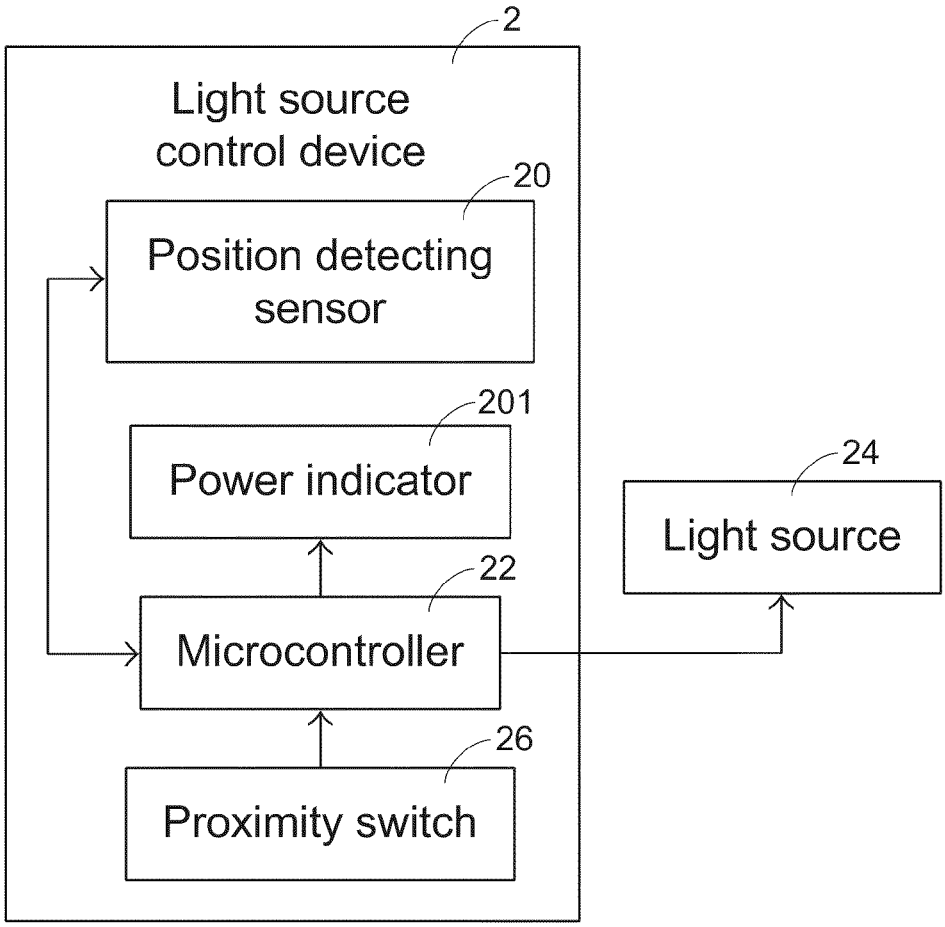
FIG. 6 is a schematic functional block diagram illustrating a light source control device according to another embodiment of the invention.

Please refer to FIG. 6. The light source control device 2 of FIG. 6 includes a position detecting sensor 20, a power indicator 201, a microcontroller 22 and a proximity switch 26. The power indicator 201 is disposed adjacent to the position detecting sensor 20. The proximity switch 26 is communicated with the microcontroller 22. The microcontroller 22 is also communicated with the power indicator 201, the position detecting sensor 20 and the light source 24. The power indicator 201 may emit a light to facilitate the user to find out the location of the switch pattern 324, 334 or 344 (as shown in FIGS. 3A, 3B and 3C, respectively) in the dark environment. The proximity switch 26 is used to detect whether an object is located within the sensing range of the light source control device 2. For example, the proximity switch 26 is an infrared sensor and an infrared transceiver periodically emits an infrared signal. If an object enters the sensing range of the light source control device 2, the infrared signal reflected from the object is received by the infrared sensor so as to indicate the presence of the object.

On the other hand, if the light source control device 2 is not used and no object within the sensing range is detected by the proximity switch 26, the proximity switch 26 generates a first power control signal to the microcontroller 22. In response to the first power control signal, the microcontroller 22 enters a standby status. When the microcontroller 22 is in the standby status, the electricity supplied to the light source control device 2 is interrupted and the light source control device 2 is in a power-saving mode, and the light source control device 2 may be instantly recovered to a normal operating mode. That is, when the light source control device 2 is not used, the microcontroller 22 enters the standby status, and the proximity switch 26 may achieve the power-saving purpose.

When the proximity switch 26 detects an object within the sensing range of the light source control device 2, the proximity switch 26 generates a second power control signal. In response to the second power control signal, the microcontroller 22 escapes from the standby status. At this moment, the microcontroller 22 enters the normal operating mode. When the microcontroller 22 is in the normal operating mode, electricity is supplied to the position detecting sensor 20 again and the power indicator 201 is turned on to facilitate the user to find out the location of the switch pattern 324, 334 or 344 (as shown in FIGS. 3A, 3B and 3C, respectively) in the dark environment. An example of the proximity switch 26 includes but is not limited to an inductive sensor, a capacitive sensor, a photoelectric sensor, a magnetic sensor, an infrared sensor or an ultrasonic sensor.

From the above description, the light source control device and the light source control method of the embodiments of the invention utilize a position detecting sensor and a microcontroller to control the illuminating status of the light source. The illuminating status of the light source includes a color, a color temperature or a brightness value of the beam emitted by the light source. When the user's finger touches a position of a touchpad or a touch panel, the beam emitted by the light source is adjusted to have the color, the color temperature or the brightness value corresponding to the touched position under control of the microcontroller. By using the light source control device and the light source control method of the embodiments of the invention, color selectivity becomes more diverse so as overcome the drawbacks encountered from the prior art.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A light source control device for controlling a light source, the light source control device comprising:

a position detecting sensor capable of generating a first signal according to an object touching a position of the position detecting sensor; and a microcontroller communicated with the position detecting sensor and capable of generating a control signal according to a light source adjustable parameter set corresponding to the first signal for controlling an illuminating status of the light source, wherein the light source adjustable parameter set comprises a plurality of color value components, and the microcontroller is capable of generating the control signal according to the color value components;

wherein the control signal comprises one of a pulse width modulation signal and an analog brightness-adjusting signal, the pulse width modulation signal or the analog brightness-adjusting signal is generated by a general purpose input/output pin or an output pin of the microcontroller.

2. The light source control device according to claim 1, wherein the illuminating status of the light source comprises color, brightness, or color temperature.

3. The light source control device according to claim 1, wherein the position detecting sensor comprises a touchpad.

4. The light source control device according to claim 3, wherein a plurality of patterns for adjusting the illuminating status are provided or printed on a surface of the touchpad, and the touchpad comprises a resistive touchpad, a capacitive touchpad, a surface acoustic wave touchpad, or an optics touchpad.

5. The light source control device according to claim 1, wherein the position detecting sensor comprises a touch panel.

6. The light source control device according to claim 5, wherein the touch panel comprises a resistive touch panel, a capacitive touch panel, a surface acoustic wave touch panel, and an optics touch panel.

7. The light source control device according to claim 1, wherein the light source comprises a plurality of light emitting diodes.

8. The light source control device according to claim 1, further comprising:

an indicator disposed adjacent to the position detecting sensor and communicated with the microcontroller; and a proximity switch communicated with the microcontroller for determining whether the object is within a predetermined sensing range, wherein if the object is beyond the predetermined sensing range, a first power control signal is generated from the proximity switch to the microcontroller to make the microcontroller enter a standby status and turn off the indicator, and if the object is within the predetermined sensing range, a second power control signal is generated from the proximity switch to the microcontroller to make the microcontroller escape from the standby status and turn on the indicator.

9. The light source control device according to claim 8, wherein the proximity switch comprises an inductive sensor, a capacitive sensor, a photoelectric sensor, a magnetic sensor, an infrared sensor, or an ultrasonic sensor.

10. The light source control device according to claim 1, further comprising:

a wireless signal emitter communicated with the microcontroller; and a wireless signal receiver communicated with the light source, wherein the microcontroller is capable of making the wireless signal emitter generate the control signal to the wireless signal receiver according to the light source adjustable parameter set, and the wireless signal receiver is capable of controlling the illuminating status of the light source according to the control signal.

11. A light source control method, comprising steps of:

generating a first signal according to an object touching a position of the position detecting sensor; and generating a control signal according to a light source adjustable parameter set corresponding to the first signal for controlling an illuminating status of the light source, wherein the light source adjustable parameter set comprises a plurality of color value components, and the control signal is generated according to the color value components;

wherein the control signal comprises one of a pulse width modulation signal and an analog brightness-adjusting signal.

12. The light source control method according to claim 11, wherein the illuminating status of the light source comprises color, brightness, or color temperature.

* * * * *